US009719157B2

(12) United States Patent
Jung et al.

(10) Patent No.: US 9,719,157 B2
(45) Date of Patent: Aug. 1, 2017

(54) HIGH-STRENGTH FLAKE GRAPHITE CAST IRON, MANUFACTURING METHOD THEREOF, AND ENGINE BODY FOR INTERNAL COMBUSTION ENGINE INCLUDING CAST IRON

(71) Applicant: Doosan Infracore Co., Ltd., Incheon (KR)

(72) Inventors: Ki Hwan Jung, Gyeonggi-do (KR); Sik Yang, Gyeonggi-do (KR); Jae Hyoung Hwang, Gyeonggi-do (KR); Young Kyu Ju, Seoul (KR); Jong Kwon Chung, Gyeonggi-do (KR); Yeniseul Lee, Gyeonggi-do (KR); Dong Seob Shim, Gyeonggi-do (KR)

(73) Assignee: Doosan Infracore Co., Ltd., Incheon (KR)

( * ) Notice: Subject to any disclaimer, the term of this patent is extended or adjusted under 35 U.S.C. 154(b) by 33 days.

(21) Appl. No.: 14/762,858

(22) PCT Filed: Jan. 6, 2014

(86) PCT No.: PCT/KR2014/000091
§ 371 (c)(1),
(2) Date: Jul. 23, 2015

(87) PCT Pub. No.: WO2014/115979
PCT Pub. Date: Jul. 31, 2014

(65) Prior Publication Data

US 2015/0368763 A1 Dec. 24, 2015

(30) Foreign Application Priority Data

Jan. 23, 2013 (KR) ..... 10-2013-0007367

(51) Int. Cl.
*C22C 37/10* (2006.01)
*F02F 7/00* (2006.01)
(Continued)

(52) U.S. Cl.
CPC ..... *C22C 37/10* (2013.01); *C21C 1/08* (2013.01); *C22C 33/08* (2013.01); *C22C 37/00* (2013.01);
(Continued)

(58) Field of Classification Search
CPC ..... F16J 9/26; F16J 1/01; F02F 1/24; F02F 7/0085; F02F 7/0021; F02F 7/0024; B22F 1/025; F02B 77/02
(Continued)

(56) References Cited

U.S. PATENT DOCUMENTS 2,749,238 A * 6/1956 Millis ..... C22C 37/04 148/322
5,580,401 A 12/1996 Williamson
(Continued)

FOREIGN PATENT DOCUMENTS

CN 1927544 A 3/2007
CN 101778959 A 7/2010
(Continued)

OTHER PUBLICATIONS

International Search Report with English translation from the Korean Intellectual Property Office mailed Apr. 8, 2014 for corresponding International Application No. PCT/KR2014/000091 filed Jan. 6, 2014, 5 pages.
(Continued)

*Primary Examiner* — Stephen K Cronin
*Assistant Examiner* — Long T Tran
(74) *Attorney, Agent, or Firm* — John D. Veldhuis-Kroeze; Westman, Champlin & Koehler, P.A.

(57) ABSTRACT

The present disclosure relates to a manufacturing method of high-strength flake graphite cast iron, the high-strength flake
(Continued)

graphite cast iron manufactured by the method, and an engine body including the cast iron, and more particularly, to flake graphite cast iron and a manufacturing method thereof, wherein the flake graphite cast iron has a uniform graphite shape and low probability of forming chill and has high tensile strength of at least 350 MPa and excellent workability and fluidity by controlling the content of manganese (Mn) and a trace of strontium (Sr), which are included in the cast iron, within a specific ratio.

15 Claims, 11 Drawing Sheets

(51) Int. Cl.

| | |
|---|---|
| ***C22C 33/08*** | (2006.01) |
| ***C22C 37/00*** | (2006.01) |
| ***C22C 37/04*** | (2006.01) |
| ***C21C 1/08*** | (2006.01) |
| ***F02F 1/24*** | (2006.01) |
| *C21D 5/00* | (2006.01) |

(52) U.S. Cl.
CPC ..... *C22C 37/04* (2013.01); *F02F 1/24* (2013.01); *F02F 7/0085* (2013.01); *C21D 5/00* (2013.01)

(58) Field of Classification Search
USPC ..... 123/193.5, 193.2
See application file for complete search history.

(56) References Cited

U.S. PATENT DOCUMENTS

| | | | | |
|---|---|---|---|---|
| 2002/0036033 | A1 | 3/2002 | Subramanian | |
| 2007/0023106 | A1* | 2/2007 | Lampic-Oplander | C22C 37/10 148/321 |
| 2010/0239451 | A1* | 9/2010 | Horie | C22C 33/08 420/15 |
| 2012/0301345 | A1* | 11/2012 | Horie | C22C 37/10 420/14 |

FOREIGN PATENT DOCUMENTS

| | | | |
|---|---|---|---|
| EP | 2166119 | A1 | 3/2010 |
| FR | 2712606 | A1 | 5/1995 |
| JP | H09111395 | A | 4/1997 |
| JP | 2004169149 | A | 6/2004 |
| JP | 2012-041571 | A | 3/2012 |
| KR | 2010-0031131 | A | 3/2010 |
| KR | 2011-0132563 | A | 12/2011 |
| RU | 227467 | C1 | 4/2006 |
| RU | 2334008 | C1 | 9/2009 |
| WO | 2010091486 | A1 | 8/2010 |

OTHER PUBLICATIONS

Chinese Office Action dated Apr. 27, 2016 for Chinese Application No. 201480005692.7, 8 pages.
European Search Report dated Aug. 5, 2016 for European Application No. 14743824.6, 7 pages.

* cited by examiner

HIGH-STRENGTH FLAKE GRAPHITE CAST IRON, MANUFACTURING METHOD THEREOF, AND ENGINE BODY FOR INTERNAL COMBUSTION ENGINE INCLUDING CAST IRON

CROSS REFERENCE TO RELATED APPLICATION

This application is a Section 371 National Stage Application of International Application No. PCT/KR2014/000091, filed Jan. 6, 2014 and published, not in English, as WO 2014/115979 A1 on Jul. 31, 2014.

FIELD OF THE DISCLOSURE

The present disclosure relates to high-strength flake graphite cast iron, a manufacturing method thereof, an engine body including the cast iron, and more particularly, to flake graphite cast iron and a manufacturing method thereof, in which the flake graphite cast iron has a uniform graphite shape and low probability of forming chill, and has high tensile strength of at least 350 MPa and excellent workability and fluidity by controlling the content ratio (Mn/Sr) of manganese (Mn) and a trace of strontium (Sr), which are included in the cast iron, within a specific range.

BACKGROUND OF THE DISCLOSURE

Since global environmental regulations have been more stringently enforced lately, it is essentially required that the content of environmental pollutants of the exhaust gas emitted from engines is reduced, and in order to solve the problem, it is necessary to raise the combustion temperature by increasing the explosion pressure of the engine. In order to withstand the explosion pressure when the explosion pressure of the engine is increased as described above, strength of an engine cylinder block and head constituting the engine needs to be increased.

A material currently used as a material for the engine cylinder block and head is flake graphite cast iron to which alloy iron, such as chromium (Cr), copper (Cu), and tin (Sn), is added. The flake graphite cast iron has excellent thermal conductivity and vibration damping and includes a trace of alloy iron, which also has excellent castability as well as low chilling probability. However, since the tensile strength ranges from 150 to 250 MPa, there is a limitation in using the flake graphite cast iron for an engine cylinder block and head, which requires an explosion pressure of more than 180 bar.

Meanwhile, high-strength, such as a tensile strength of approximately 300 MPa, is required for a material for an engine cylinder block and head to withstand an explosion pressure of more than 180 bar. For this purpose, a pearlite stabilizing element such as copper (Cu) and tin (Sn), or a carbide production promoting element such as chromium (Cr) and molybdenum (Mo) needs to be further added, but since the addition of such alloy iron potentially includes the chilling tendency, there is a problem of increasing the likelihood that chills occur at a thin walled part of an engine cylinder block and head having a complicated shape.

The related art for achieving high strength of the flake graphite cast iron is to form an MnS sulfide by controlling the ratio of using manganese (Mn) and sulfur (S) added to the cast iron melt, that is, Mn/S to a specific ratio. In this case, the Mn/S sulfide formed serves to promote the nucleation of graphite and reduce chilling by the addition of alloy iron, and the method may be applied only to the high-manganese cast iron melt, in which the content of manganese (Mn) is approximately from 1.1 to 3.0%. Manganese (Mn) reinforces the matrix structure by promoting the pearlite structure and making cementite spacing in the pearlite structure dense, but when manganese (Mn) is added in a large amount, manganese (Mn) stabilizes the carbide and suppresses the growth of graphite, so that the strength may be increased to 350 MPa or more, but when the Mn/S ratio is not controlled within a specific range, chilling is further promoted and fluidity is rather reduced due to the high content of manganese. Accordingly, there is a limitation in applying the flake graphite cast iron as a material for an engine cylinder block and head having a complicated structure.

Recently, compacted graphite iron (CGI) cast iron simultaneously satisfying high tensile strength of 350 MPa or more while having excellent castability, vibration damping capacity, and thermal conductivity of the flake graphite cast iron has been applied as a material for an engine cylinder block and head having a high explosion pressure. In order to make a CGI cast iron having a tensile strength of 350 MPa or more, high-quality pig iron having low content of impurities such as sulfur (S) and phosphorus (P), and a molten material need to be used, and it is necessary to precisely control magnesium (Mg) which is a graphite-spheroidizing element. However, since it is difficult to control magnesium (Mg) and magnesium is very sensitive to a change in melting and casting conditions, such as a tapping temperature and a tapping rate, it is highly likely that material defects and casting defects of CGI cast iron will occur, and there is a problem in that the costs of production increase.

Since CGI cast iron has relatively worse workability than flake graphite cast iron, when an engine cylinder block and head is manufactured using CGI cast iron, processing is not performed in a processing line dedicated to the existing flake graphite cast iron and it is essentially required that the processing line is changed into a processing line dedicated to CGI cast iron. Therefore, there is a problem concerning the occurrence of enormous facility investment costs.

The discussion above is merely provided for general background information and is not intended to be used as an aid in determining the scope of the claimed subject matter.

SUMMARY

This summary and the abstract are provided to introduce a selection of concepts in a simplified form that are further described below in the Detailed Description. The summary and the abstract are not intended to identify key features or essential features of the claimed subject matter.

The present disclosure has been contrived to solve the aforementioned problems, and an embodiment of the present disclosure is to provide a flake graphite cast iron and a manufacturing method thereof, in which the flake graphite cast iron simultaneously has workability and fluidity equivalent to the related art while securing high strength, such as a tensile strength of 350 MPa or more without an increase in chill even though manganese (Mn) is added in a large amount, by controlling the content of manganese (Mn) and the content ratio (Mn/Sr) of manganese (Mn) and a trace of strontium (Sr) in the components, which are added to cast iron, within a specific range.

Further, another embodiment of the present disclosure is to provide a cast iron having stable physical properties and structure by precisely controlling the ratio of using manganese (Mn) and strontium (Sr), and particularly, flake graphite cast iron which is applicable to an engine body for an internal combustion engine having a complicated shape, for example a large and medium-sized engine cylinder block and/or a large and medium-sized engine cylinder head.

An exemplary embodiment of the present disclosure provides a flake graphite cast iron including 3.0 to 3.2% of carbon (C), 2.0 to 2.3% of silicon (Si), 1.3 to 1.6% of manganese (Mn), 0.1 to 0.13% of sulfur (S), 0.06% or less of phosphorus (P), 0.6 to 0.8% of copper (Cu), 0.25 to 0.35% of molybdenum (Mo), 0.003 to 0.006% of strontium (Sr), and the balance iron (Fe) satisfying 100% as a total weight %, and having a chemical composition, in which the ratio (Mn/Sr) of the content of manganese (Mn) to the content of strontium (Sr) is in a range of 216 to 515, for example flake graphite cast iron for a large and medium-sized engine cylinder block and engine cylinder head.

According to an exemplary embodiment of the present disclosure, the carbon equivalent (CE) of the flake graphite cast iron is allowed to be in a range of 3.7 to 4.0 when calculated by a method of CE=% C+% Si/3.

Further, according to another exemplary embodiment of the present disclosure, the flake graphite cast iron may have a tensile strength in a range of 355 to 375 MPa and a Brinell hardness (BHW) in a range of 245 to 279.

Meanwhile, according to an exemplary embodiment of the present disclosure, in the flake graphite cast iron, a wedge test specimen may have a chill depth of 3 mm or less.

In addition, in the flake graphite cast iron, a fluidity test specimen may have a spiral length of 730 mm or more.

Another exemplary embodiment of the present disclosure provides a method for manufacturing the aforementioned high-strength flake graphite cast iron.

More specifically, the manufacturing method may include: (i) manufacturing a cast iron melt including 3.0 to 3.2% of carbon (C), 2.0 to 2.3% of silicon (Si), 1.3 to 1.6% of manganese (Mn), 0.1 to 0.13% of sulfur (S), 0.06% or less of phosphorus (P), 0.6 to 0.8% of copper (Cu), 0.25 to 0.35% of molybdenum (Mo), and the balance iron (Fe) based on a total weight %; (ii) adding strontium (Sr) to the melted cast iron melt, in which the ratio (Mn/Sr) of the content of manganese (Mn) to the content of strontium (Sr) is adjusted to be in a range of 216 to 515; and (iii) tapping the cast iron melt into a ladle and injecting the cast iron melt into a prepared mold.

Herein, the amount of strontium (Sr) added is for example in a range of 0.003% to 0.006% based on the total weight % of the cast iron melt.

According to an exemplary embodiment of the present disclosure, the cast iron melt in step (i) may be manufactured by adding 0.6 to 0.8% of copper (Cu) and 0.25 to 0.35% of molybdenum (Mo) to a cast iron melt formed by melting a cast iron material including 3.0 to 3.2% of carbon (C), 2.0 to 2.3% of silicon (Si), 1.3 to 1.6% of manganese (Mn), 0.1 to 0.13% of sulfur (S), 0.06% or less of phosphorus (P), and the balance iron (Fe) based on the total weight % in a furnace.

In addition, according to an exemplary embodiment of the present disclosure, an Fe—Si-based inoculant is added one or more times in step (iii). More specifically, the Fe—Si-based inoculant may be added when the cast iron melt is tapped into the ladle, when the cast iron melt is injected into the prepared mold, or in both of the steps.

Yet another exemplary embodiment of the present disclosure provides an engine body for an internal combustion engine including an engine cylinder block, an engine cylinder head, or both, which are made of the aforementioned flake graphite cast iron.

Herein, the engine cylinder block or the engine cylinder head may include a thin walled part having a cross-sectional thickness of 5 mm to 10 mm and a thick walled part having a cross-sectional thickness of 30 mm or more, and the graphite shape constituting the thin walled part may be an A+D type. Furthermore, the engine body may have an explosion pressure of more than 220 bar.

According to the present disclosure, the tensile strength, the chill depth, and the fluidity may vary depending on the ratio of the amounts of manganese (Mn) and strontium (Sr) added, and the ratio of Mn/Sr needs to be in a range of 216 to 515 in order to be applied to a high-strength engine cylinder block and head which has a complicated shape so that a thick walled part and a thin walled part are simultaneously present.

As described above, according to the present disclosure, it is possible to provide flake graphite cast iron which has a high tensile strength of 355 to 375 MPa and excellent workability and fluidity by precisely controlling the amount of strontium (Sr) and the ratio (Mn/Sr) of the content of manganese (Mn) to the content of strontium (Sr), and is suitable for being used in, for example, engine parts of an internal combustion engine, and the like, and a manufacturing method thereof.

DESCRIPTION OF MAIN REFERENCE NUMERALS OF THE DRAWINGS

Figure 1:
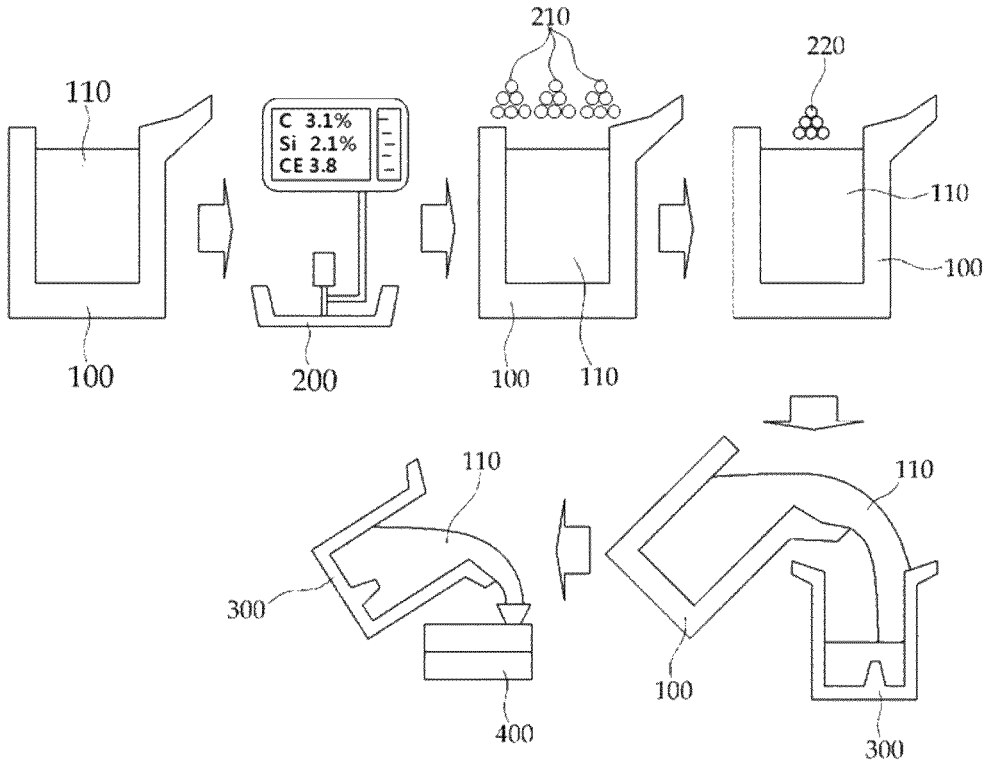
FIG. 1 schematically illustrates an example of a manufacturing process of high-strength flake graphite cast iron for an engine cylinder block and head according to the present disclosure.

| | |
|---|---|
| 1: Engine cylinder block | |
| 2: Thin walled part having a cross-sectional thickness of 5 mm to 10 mm | |
| 100: Furnace | 110: Cast iron melt |
| 210: Copper, Molybdenum, and Manganese | 220: Strontium |
| 300: Ladle | 400: Mold |

DETAILED DESCRIPTION

Hereinafter, the present disclosure will be described in detail through the Examples.

The present disclosure uses a trace of strontium (Sr) as a component of cast iron, in which the content ratio (Mn/Sr) of manganese (Mn) and strontium (Sr) in the cast iron is controlled within a specific range.

Since the strontium (Sr) and manganese (Mn), which are adjusted to the specific content ratio as described above, are each reacted with sulfur (S) in the cast iron so as to form SrS and MnS sulfides, and the SrS thus formed serves as a strong nucleation site in which flake graphite may be grown while the SrS is surrounding MnS, it is possible to simultaneously achieve high strength and excellent workability and fluidity by suppressing the reaction chillation and aiding in the growth and crystallization of good A-type flake graphite, even though pearlite and a chill promoting element Mn are added in a large amount of 1% or more.

In this case, the content of strontium (Sr) added and the content ratio (Mn/Sr) of strontium (Sr) and manganese (Mn) in the cast iron are the most important factors in manufacturing high-strength flake graphite cast iron having a tensile strength of 350 MPa or more. Accordingly, the flake graphite cast iron of the present disclosure needs to be limited to the manufacturing method exemplified below and the corresponding chemical composition.

Hereinafter, the chemical composition of the flake graphite cast iron according to the present disclosure and the manufacturing method for the flake graphite cast iron will be described. Herein, the amount of each element added is represented as wt %, and will be represented simply as % in the following description.

Further, each value showing the amount, size and range mentioned in the present specification may be inferred by applying at least the number of significant figures and a typical allowable error, a rounding half-up rule, a measurement error, and the like.

<Flake Graphite Cast Iron>

The high-strength flake graphite cast iron according to the present disclosure includes 3.0 to 3.2% of carbon (C), 2.0 to 2.3% of silicon (Si), 1.3 to 1.6% of manganese (Mn), 0.1 to 0.13% of sulfur (S), 0.06% or less of phosphorus (P), 0.6 to 0.8% of copper (Cu), 0.25 to 0.35% of molybdenum (Mo), 0.003 to 0.006% of strontium (Sr), and the balance iron (Fe) satisfying 100% as a total weight %, and has a chemical composition, in which the ratio (Mn/Sr) of the content of manganese (Mn) to the content of strontium (Sr) is in a range of 216 to 515.

In the present disclosure, the reason for adding each component contained in the flake graphite cast iron and the reason for limiting the range of the content of each component added are as follows.

1) Carbon (C) 3.0 to 3.2%

Carbon is an element which crystallizes good flake graphite. When the content of carbon (C) in the flake graphite cast iron according to the present disclosure is less than 3.0%, an A+B type flake graphite may be crystallized in a thick walled part in which an engine cylinder block and head has a cross-sectional thickness of 30 mm or more, but a D+E type graphite, which is not good flake graphite, is crystallized in a thin walled part in which the engine cylinder block and head has a thickness of 5 to 10 mm or less, and thus the cooling rate is relatively fast, thereby leading to a high probability of an occurrence of chills and incurring deterioration in workability. Furthermore, when the content of carbon (C) exceeds 3.2%, high-strength flake graphite cast iron may not be obtained because a ferrite structure is formed as flake graphite is excessively crystallized, thereby leading to reduction in tensile strength. Accordingly, in exemplary embodiments the content of carbon (C) in the present disclosure is limited to 3.0 to 3.2% in order to prevent the aforementioned defects in the high-strength engine cylinder block and head having various thicknesses.

2) Silicon (Si) 2.0 to 2.3%

When silicon (Si) and carbon are added at an optimum ratio, the amount of flake graphite crystallized may be maximized, the occurrence of chills is reduced, and the strength is increased. When the content of silicon (Si) in the flake graphite cast iron according to the present disclosure is less than 2.0%, deterioration in workability due to the formation of chills is caused, and when the content thereof exceeds 2.3%, high-strength flake graphite cast iron may not be obtained due to reduction in tensile strength caused by excessive crystallization of flake graphite. Accordingly, in exemplary embodiments the content of silicon (Si) in the present disclosure is limited to 2.0 to 2.3%.

3) Manganese (Mn) 1.3 to 1.6%

Manganese (Mn) is an element which makes the interlayer spacing in pearlite dense and reinforces the matrix of flake graphite cast iron. When the content of manganese (Mn) in the flake graphite cast iron according to the present disclosure is less than 1.3%, it is difficult to obtain high-strength flake graphite cast iron because the content fails to significantly affect the reinforcement of the matrix for obtaining a tensile strength of 350 MPa or more, and when the content of manganese (Mn) exceeds 1.6%, the effect of stabilizing carbides is more significant than the effect of reinforcing the matrix, so that the tensile strength is increased, but the chilling tendency increases, thereby incurring deterioration in workability. Further, fluidity deteriorates. Accordingly, in exemplary embodiments the content of manganese (Mn) in the present disclosure is limited to 1.3 to 1.6%.

4) Sulfur (S) 0.1 to 0.13%

Sulfur (S) is reacted with trace elements included in the melt to form sulfides, and the sulfide serves as a nucleation site of the flake graphite to aid in the growth of the flake graphite. In the flake graphite cast iron according to the present disclosure, high-strength flake graphite cast iron may be manufactured only when the content of sulfur (S) is 0.1% or more. When the content of sulfur (S) exceeds 0.13%, fluidity deteriorates, and the tensile strength of the material is reduced and brittleness is increased due to the segregation of sulfur (S), and thus, in exemplary embodiments the content of sulfur (S) according to the present disclosure is limited to 0.1 to 0.13%.

5) Phosphorus (P) 0.06% or Less

Phosphorus is a kind of impurity naturally added in the manufacturing process of cast iron in air. The phosphorus (P) stabilizes pearlite and is reacted with trace elements included in the melt to form a phosphide (steadite), thereby serving to reinforce the matrix and enhance abrasion resistance, but when the content of phosphorus (P) exceeds 0.06%, brittleness rapidly increases. Accordingly, in exemplary embodiments the content of phosphorus (P) in the present disclosure is limited to 0.06% or less. In this case, the lower limit of the content of phosphorus (P) may exceed 0%, but does not need to be particularly limited.

6) Copper (Cu) 0.6 to 0.8%

Copper (Cu) is an element which reinforces the matrix of flake graphite cast iron, and is an element necessary for securing strength because the element acts to promote the production of pearlite and make pearlite finer. In the high-strength flake graphite cast iron for an engine cylinder block and head according to the present disclosure, when the content of copper (Cu) is less than 0.6%, insufficient tensile strength is incurred, but even though the addition amount thereof exceeds 0.8%, there is a problem in that the material costs are increased because an addition effect corresponding to the surplus is minimally obtained. Accordingly, in exemplary embodiments the content of copper (Cu) in the present disclosure is limited to 0.6 to 0.8%.

7) Molybdenum (Mo) 0.25 to 0.35%

Molybdenum (Mo) is an element which reinforces the matrix of flake graphite cast iron, and accordingly enhances the strength of the material, and also enhances the strength at high temperature. In the high-strength flake graphite cast iron for an engine cylinder block and head according to the present disclosure, when the content of molybdenum (Mo) is less than 0.25%, it is difficult to obtain a tensile strength required for the present disclosure, and insufficient high temperature tensile strength occurs while being applied to an engine cylinder block and head in which the operating temperature is high when the explosion pressure is raised to 220 bar or more. Meanwhile, when the content of molybdenum (Mo) exceeds 0.35%, the tensile strength may be slightly increased because the effect of reinforcing the matrix is significant at a high temperature, but workability significantly deteriorates due to production of Mo carbides, and there is a problem in that material costs are increased. Accordingly, in exemplary embodiments the content of molybdenum (Mo) in the present disclosure is limited to 0.25 to 0.35%.

8) Strontium (Sr) 0.003 to 0.006%

Strontium (Sr) is a strong graphitization element which reacts even with a trace of sulfur (S) when being solidified to form SrS sulfides, in which the SrS sulfide formed serves as a strong nucleation site in which flake graphite may be grown while the SrS sulfide is surrounding the MnS sulfide, thereby promoting the good A-type graphite. In the present disclosure, a content of strontium (Sr) of 0.003% or more is needed in order to prevent chillation due to the addition of a large amount of manganese (Mn) and enhance the strength by crystallizing good flake graphite. However, since the strontium (Sr) has a high oxidizing property, when more than 0.006% of strontium is added, the generation of the nucleus of the flake graphite is disturbed due to the oxidation to produce a D+E type flake graphite and to cause the chillation, thereby leading to deterioration in workability. Accordingly, in exemplary embodiments the content of strontium (Sr) in the present disclosure is limited to 0.003 to 0.006%, and more specifically, the content of strontium (Sr) may be in a range of 0.0031 to 0.0060%.

9) Iron (Fe)

Iron is a main material of the cast iron according to the present disclosure. The balance component other than the aforementioned components is iron (Fe), and the other inevitable impurities may be partially included.

The flake graphite cast iron of the present disclosure may be limited to the chemical composition, and an A+D type flake graphite may be obtained by adjusting the ratio (Mn/Sr) of the content of manganese (Mn) to the content of strontium (Sr) to a range of 216 to 515, and in exemplary embodiments a range of 299 to 451 even though manganese (Mn), which is an element that reinforces the matrix and stabilizes carbides, is added in a large amount for manufacturing high-strength flake graphite cast iron, and it is possible to obtain high-strength flake graphite cast iron for an engine cylinder block and head, which has a tensile strength of 350 MPa or more and excellent workability because the chillation is reduced.

According to an exemplary embodiment of the present disclosure, the carbon equivalent (CE) of the flake graphite cast iron is allowed to be in a range of 3.7 to 4.00, and may in exemplary embodiments be in a range of 3.74 to 3.92, when calculated by a method of CE=% C+% Si/3. When the carbon equivalent is less than 3.70, a D+E type flake graphite is produced and chills occur at a thin walled part having a cross-sectional thickness of approximately 5 to 10 mm, thereby incurring casting defects and deterioration in workability. Further, when the carbon equivalent exceeds 4.00, the tensile strength deteriorates due to the excessive crystallization of process graphite. Accordingly, it is preferred that the range of the carbon equivalent in the present disclosure is limited to a range of 3.70 to 4.00, and the carbon equivalent may be appropriately adjusted in order to control the mechanical properties and quality of the engine cylinder block and head in the range.

According to an exemplary embodiment of the present disclosure, the flake graphite cast iron having the aforementioned chemical composition may have a tensile strength in a range of 355 to 375 MPa. In addition, the Brinell hardness (BHW) is in a range of 245 to 279, and may be in exemplary embodiments in a range of 258 to 279.

Figure 2:
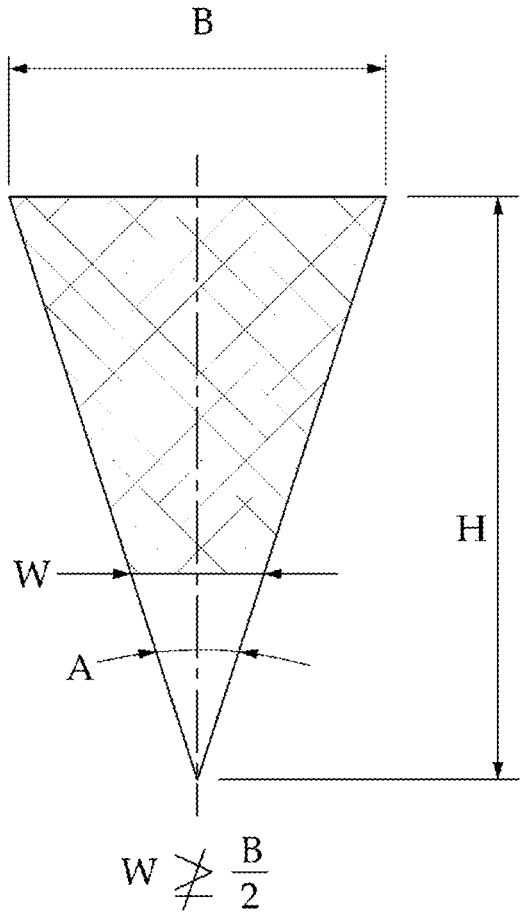
FIG. 2 illustrates a wedge test specimen for measuring the chill height of the flake graphite cast iron according to the present disclosure.

According to an example of the present disclosure, a wedge test specimen to which the flake graphite cast iron having the chemical composition is applied has a chill depth of 3 mm or less, in exemplary embodiments, 2 mm or less. In this case, the wedge test specimen in which the chill depth is measured may be illustrated as in the following FIG. 2.

Figure 3:
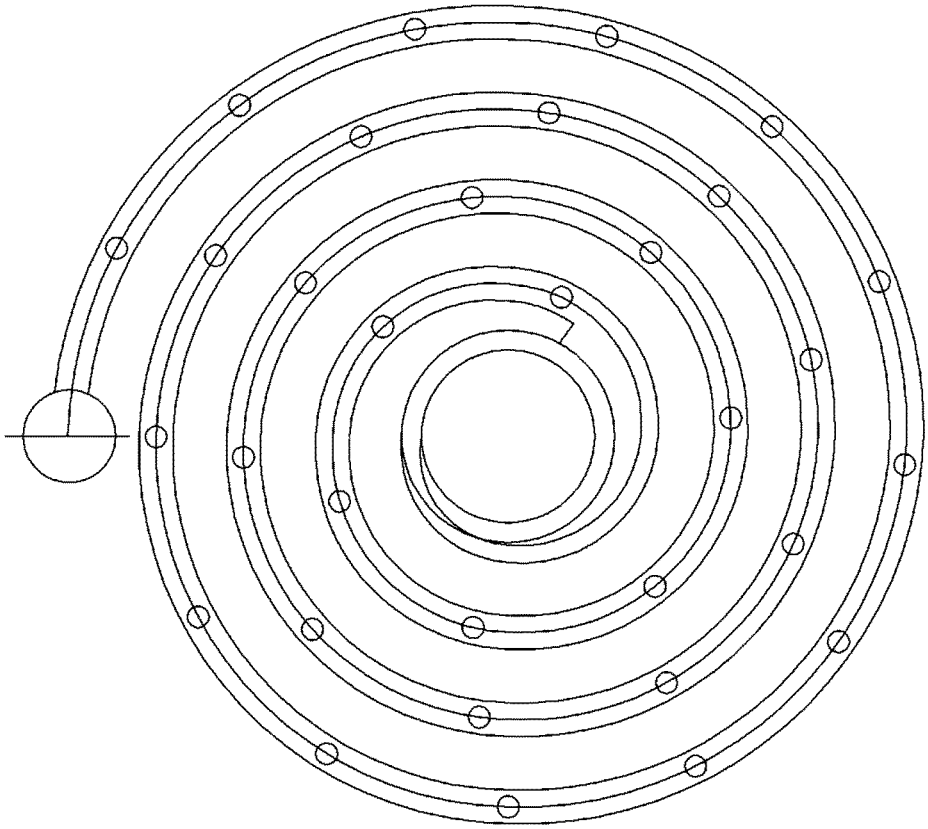
FIG. 3 illustrates a metal mold for manufacturing a spiral test specimen for measuring the fluidity of the flake graphite cast iron according to the present disclosure.
Figure 4:
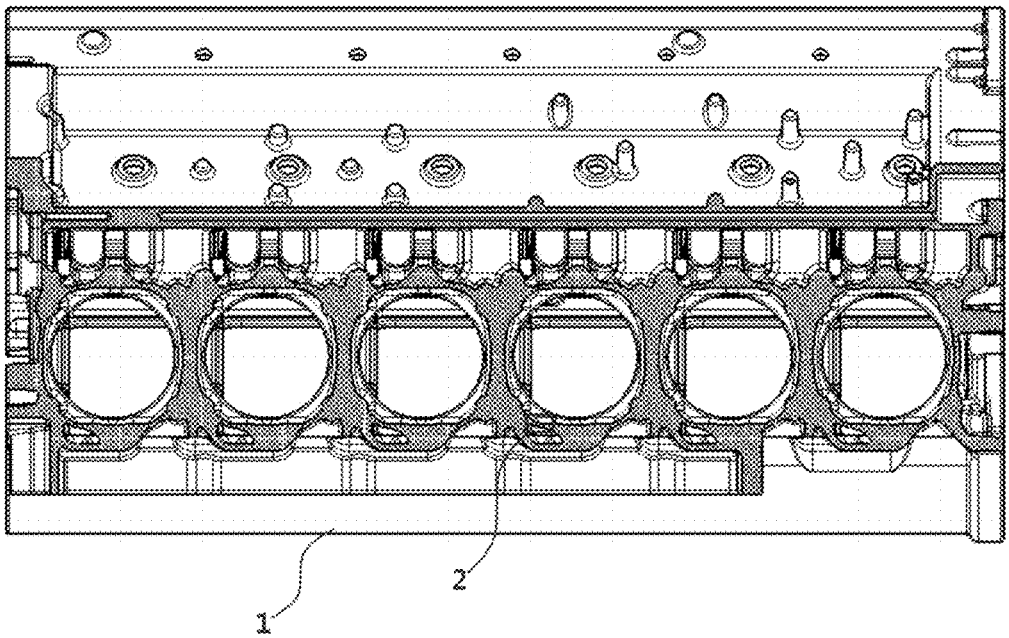
FIG. 4 is a plan cross-sectional view illustrating a thin walled part in the cylinder block according to the present disclosure.
Figure 5:
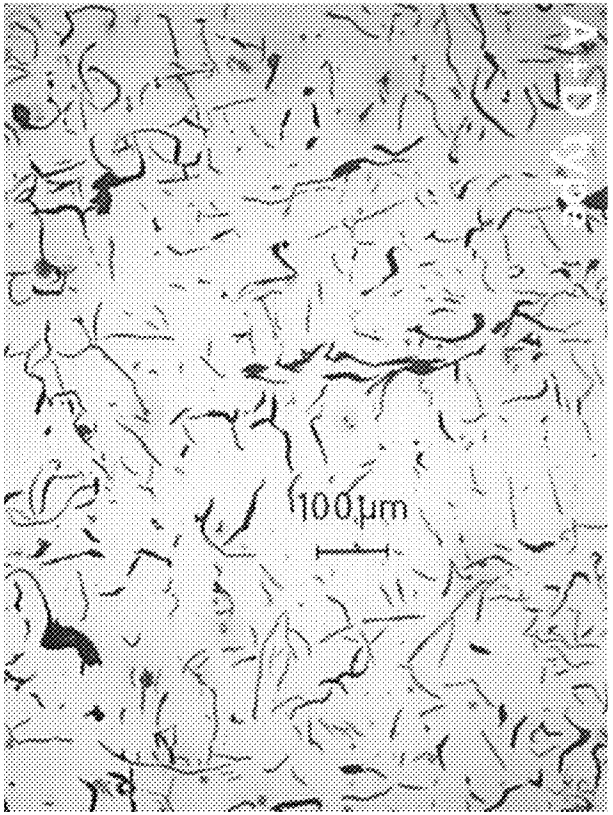
FIG. 5 is a photograph of the surface structure of a thin walled part in which the flake graphite cast iron of Example 1 is applied to a cylinder block.
Figure 6:
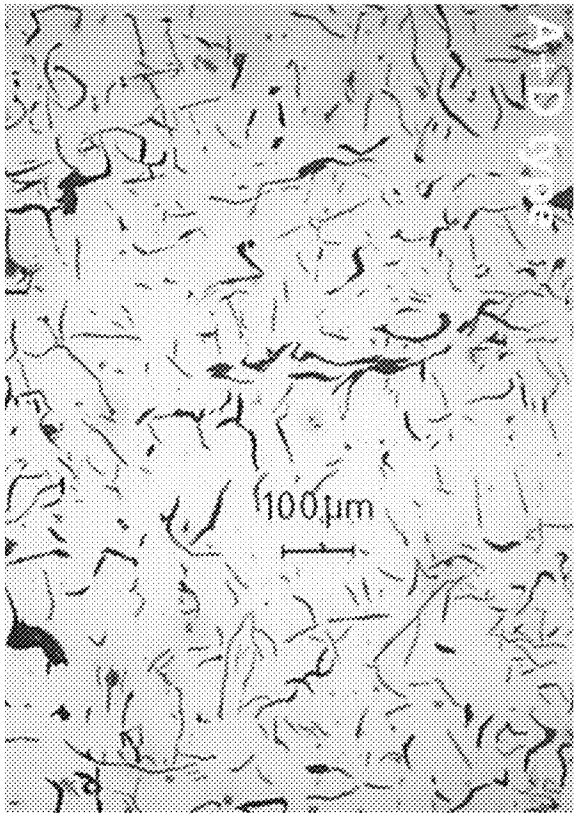
FIG. 6 is a photograph of the surface structure of a thin walled part in which the flake graphite cast iron of Example 2 is applied to a cylinder block.
Figure 7:
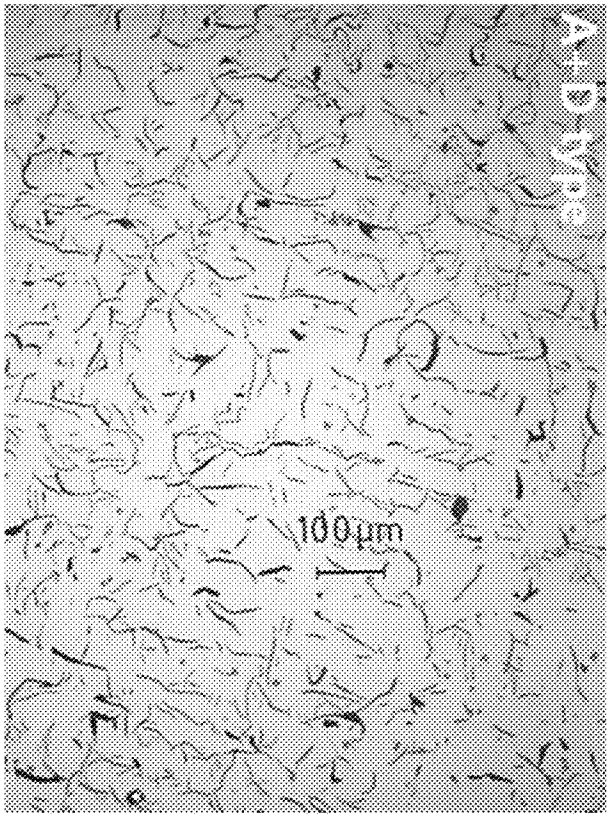
FIG. 7 is a photograph of the surface structure of a thin walled part in which the flake graphite cast iron of Example 3 is applied to a cylinder block.
Figure 8:
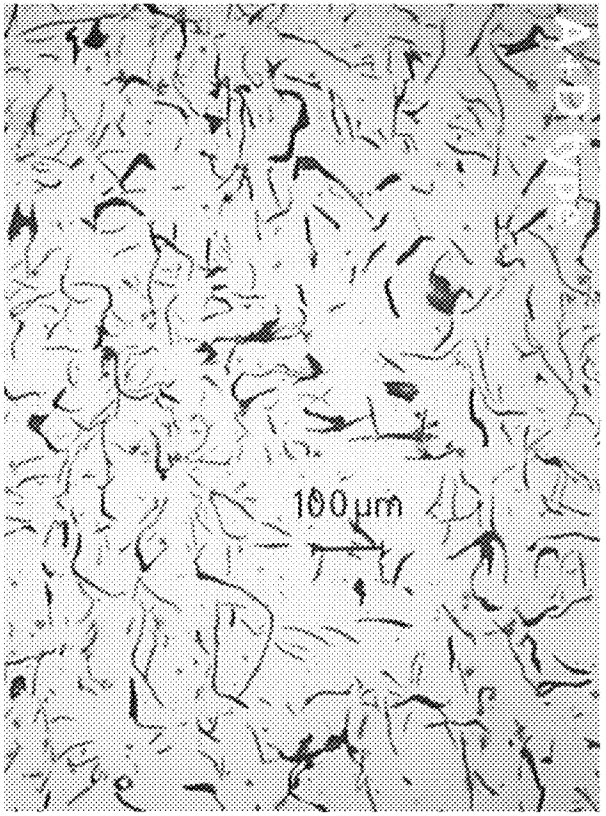
FIG. 8 is a photograph of the surface structure of a thin walled part in which the flake graphite cast iron of Example 4 is applied to a cylinder block.
Figure 9:
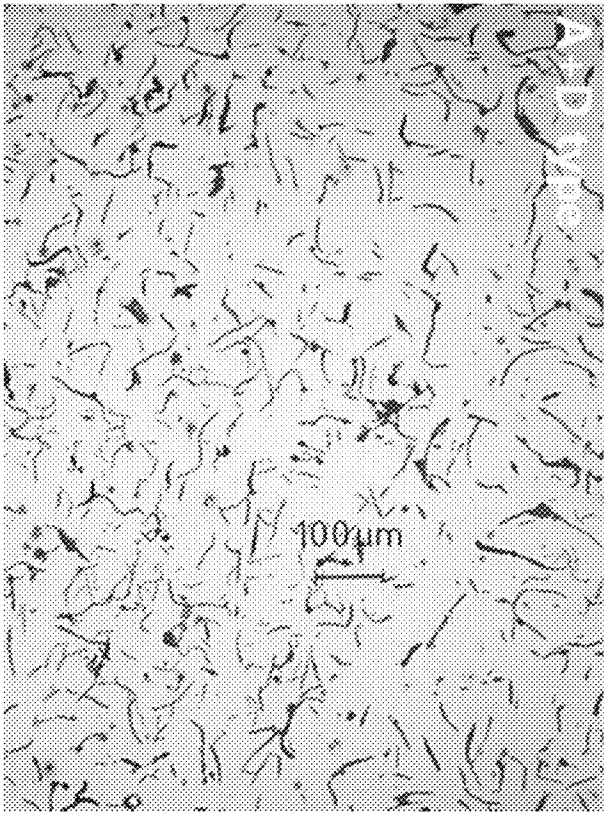
FIG. 9 is a photograph of the surface structure of a thin walled part in which the flake graphite cast iron of Example 5 is applied to a cylinder block.
Figure 10:
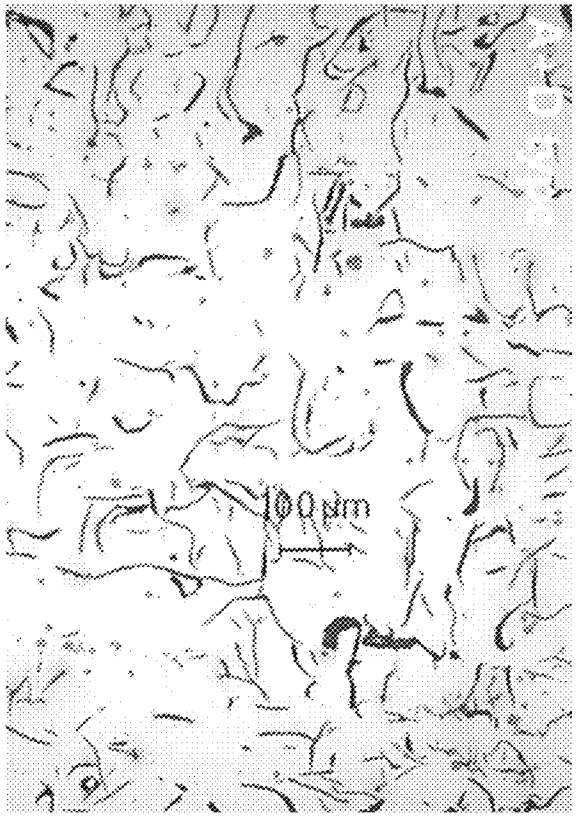
FIG. 10 is a photograph of the surface structure of a thin walled part in which the flake graphite cast iron of Example 6 is applied to a cylinder block.
Figure 11:
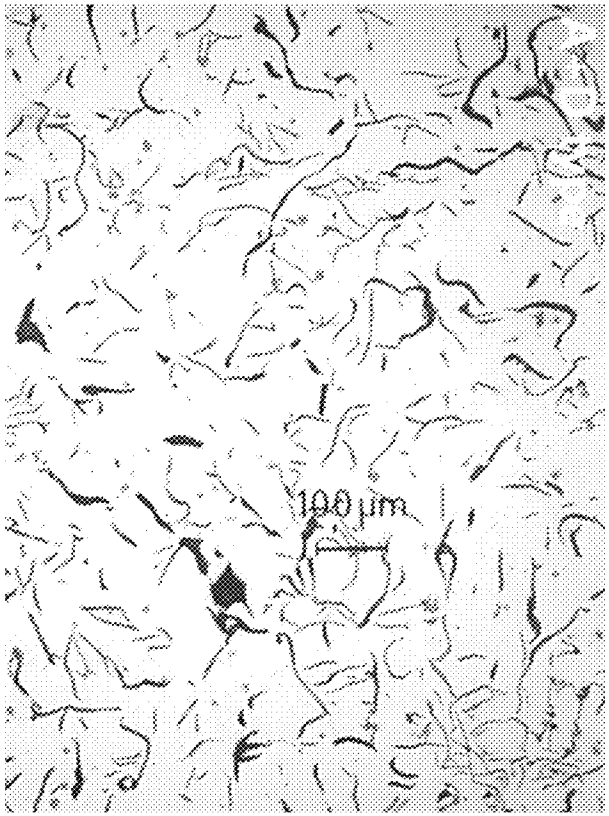
FIG. 11 is a photograph of the surface structure of a thin walled part in which the flake graphite cast iron of Example 7 is applied to a cylinder block.
Figure 12:
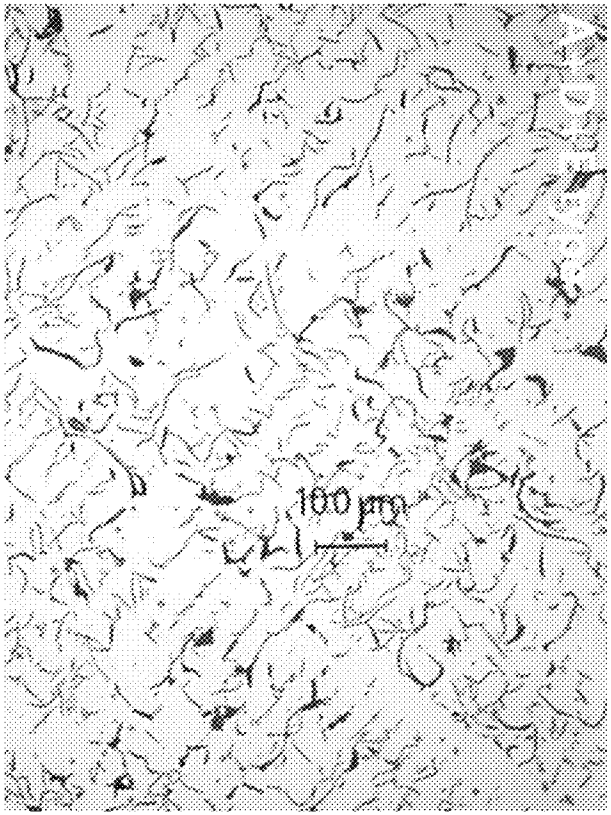
FIG. 12 is a photograph of the surface structure of a thin walled part in which the flake graphite cast iron of Comparative Example 1 is applied to a cylinder block.
Figure 13:
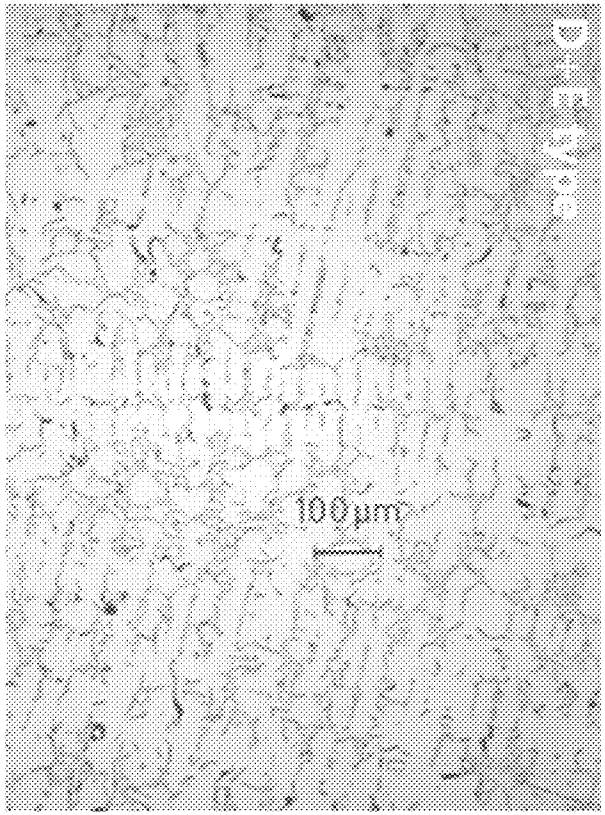
FIG. 13 is a photograph of the surface structure of a thin walled part in which the flake graphite cast iron of Comparative Example 2 is applied to a cylinder block.
Figure 14:
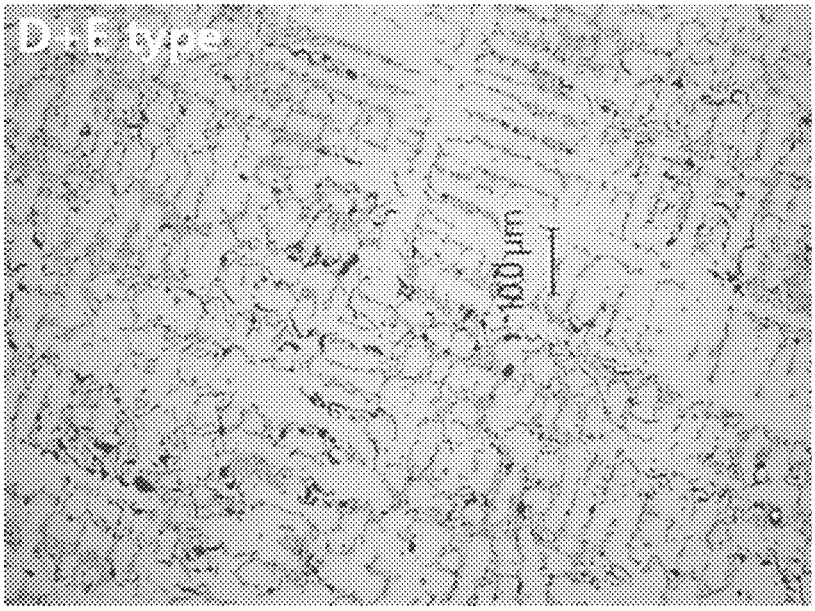
FIG. 14 is a photograph of the surface structure of a thin walled part in which the flake graphite cast iron of Comparative Example 3 is applied to a cylinder block.
Figure 15:
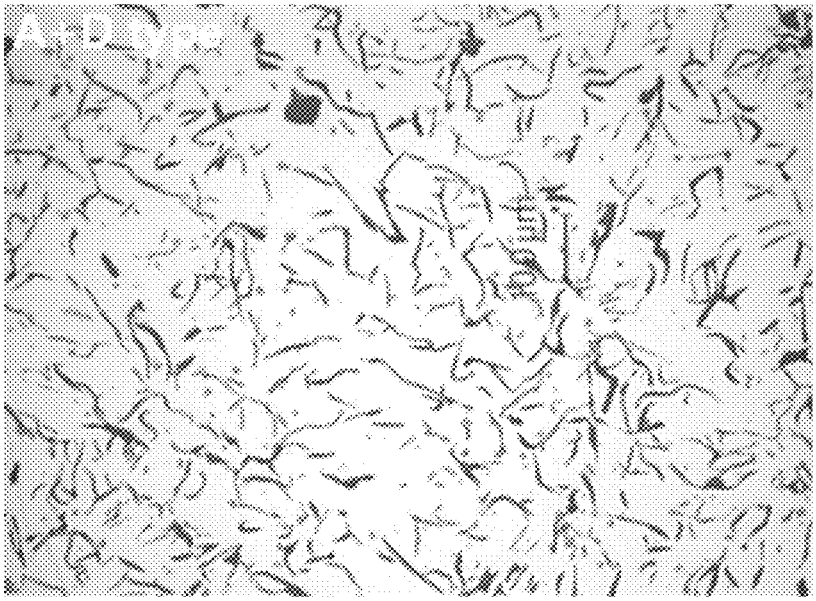
FIG. 15 is a photograph of the surface structure of a thin walled part in which the flake graphite cast iron of Comparative Example 4 is applied to a cylinder block.
Figure 16:
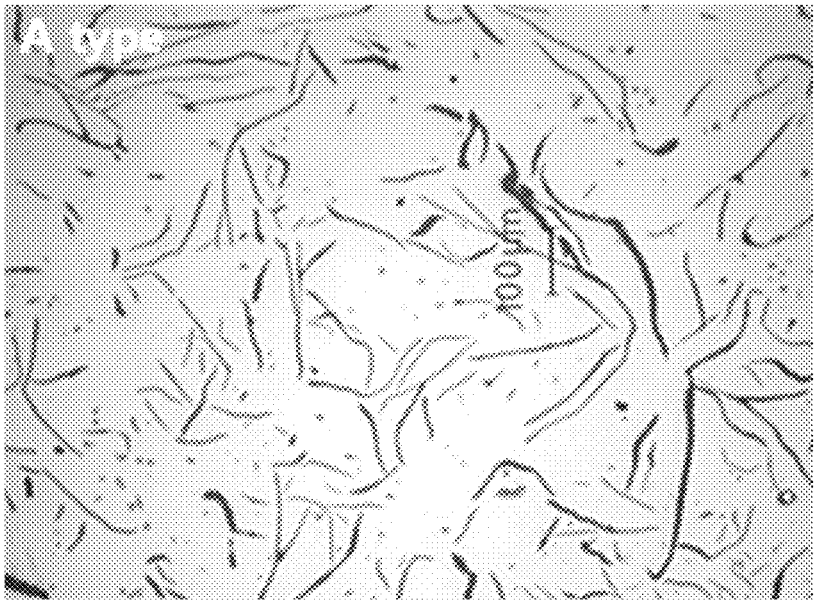
FIG. 16 is a photograph of the surface structure of a thin walled part in which the flake graphite cast iron of Comparative Example 5 is applied to a cylinder block.
Figure 17:
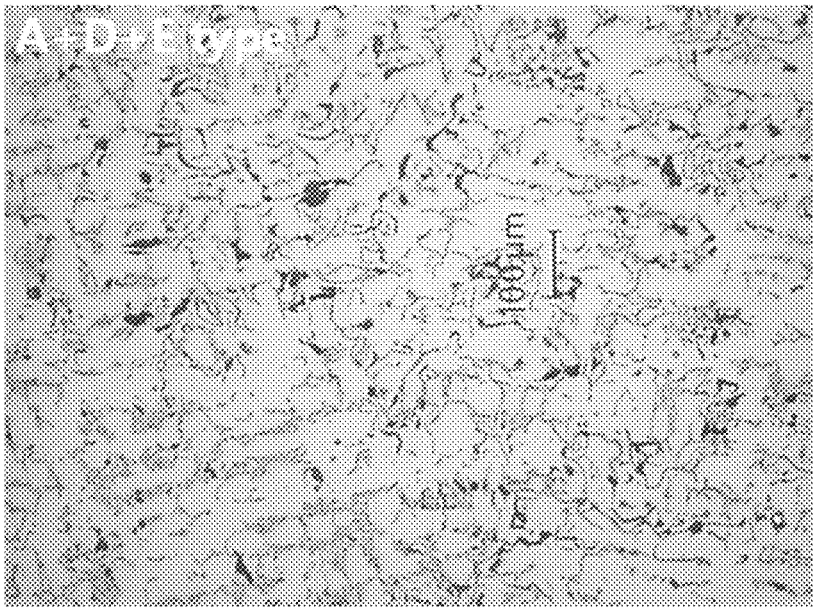
FIG. 17 is a photograph of the surface structure of a thin walled part in which the flake graphite cast iron of Comparative Example 6 is applied to a cylinder block.
Figure 18:
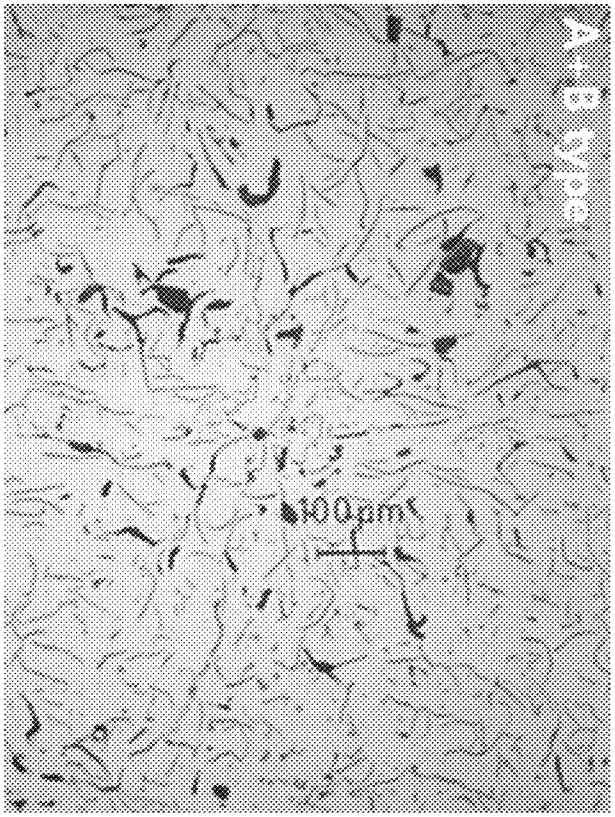
FIG. 18 is a photograph of the surface structure of a thin walled part in which the flake graphite cast iron of Comparative Example 7 is applied to a cylinder block.

In addition, according to an example of the present disclosure, a fluidity test specimen to which the flake graphite cast iron having the chemical composition is applied may have a spiral length of 730 mm or more, in exemplary embodiments, 738 mm or more. In this case, the fluidity test specimen may be illustrated as in the following FIG. 3. The upper limit of the spiral length in the fluidity test specimen is not particularly limited, and as an example, may be an end point of the spiral length which the fluidity test specimen standard has.

<Manufacturing Method for Flake Graphite Cast Iron>

The manufacturing method for the high-strength flake graphite cast iron having the aforementioned chemical composition according to the present disclosure is as follows.

However, the manufacturing method is not limited to the following manufacturing method, and if necessary, the step of each process may be modified or optionally mixed and performed.

When the explanation is made with reference to FIG. 1, first, 1) manufactured is a cast iron melt 110 including 3.0 to 3.2% of carbon (C), 2.0 to 2.3% of silicon (Si), 1.3 to 1.6% of manganese (Mn), 0.1 to 0.13% of sulfur (S), 0.06% or less of phosphorus (P), 0.6 to 0.8% of copper (Cu), 0.25 to 0.35% of molybdenum (Mo) and the balance iron (Fe) based on a total weight %.

The method for manufacturing the cast iron melt 110 according to the present disclosure is not particularly limited, and as an example, a cast iron melt 110 is prepared such that the aforementioned chemical composition is obtained by melting a cast iron material in which carbon (C), silicon (Si), manganese (Mn), sulfur (S) and phosphorus (P), which are five main elements of cast iron, are contained in the aforementioned content ranges in a furnace to manufacture the cast iron melt, and adding alloy iron 210, such as copper (Cu) and molybdenum (Mo), thereto.

In this case, phosphorus (P) may be included as an impurity in a raw material for casting, or may also be separately added. Meanwhile, in the present disclosure, since the reason for limiting the chemical composition in the melt is the same as the reason described in the case of the chemical composition of the flake graphite cast iron to be described below, the explanation thereof will be omitted.

2) Strontium (Sr) 220 is added to the cast iron melt 110 melt as described above, and is added such that the ratio (Mn/Sr) of the content of manganese (Mn) to the content of strontium (Sr) is in a range of 216 to 515. In this case, the amount of strontium (Sr) 220 added is in exemplary embodiments in a range of 0.003 to 0.006%, and more specifically, may be in a range of 0.0031 to 0060%, based on the total weight % of the cast iron melt.

In the present disclosure, the chemical composition of flake graphite cast iron is limited as described above, and simultaneously, the ratio (Mn/Sr) of the content of manganese (Mn) to the content of strontium (Sr) needs to be limited to a range of 216 to 515, and may be in exemplary embodiments in a range of 299 to 451. When the ratio of Mn/Sr is less than 216, strength deteriorates, and when the ratio of Mn/Sr exceeds 515, the hardness is increased, thereby leading to deterioration in workability. An A+D type flake graphite may be obtained by limiting the ratio of Mn/Sr as described above even though manganese (Mn), which is an element that reinforces the matrix and stabilizes carbides, is added in a large amount for manufacturing high-strength flake graphite cast iron, and it is possible to obtain high-strength flake graphite cast iron for an engine cylinder block and head, which has a tensile strength of 350 MPa or more and excellent workability because the chillation is reduced.

In the cast iron melt 110 manufactured as described above, a component analysis of the melt is completed using a carbon equivalent measuring device, a carbon/sulfur analyzer and a spectrometer.

3) The cast iron melt is tapped into a ladle 300 which is a container for tapping, and then is injected into a prepared mold, and in this case, an Fe—Si-based inoculant may be added thereto at least one time.

As an exemplary example of the step, in terms of stabilizing a material for high-strength flake graphite cast iron, first, an Fe—Si-based inoculant is added simultaneously with the tapping (primary inoculation treatment), and next, the Fe—Si-based inoculant is added simultaneously with the injection (secondary inoculation treatment). In this case, the size of the inoculant to be input may be in a range of 0.5 to 3 mm in diameter, and in exemplary embodiments the amount of the inoculant to be input during the ladle tapping is limited to 0.3±0.05% by weight (%) in order to obtain an effect of stabilizing the material for the high-strength flake graphite cast iron.

The melt temperature of the ladle in which the tapping has been completed is measured by using an immersion-type thermometer, and after the temperature is measured, the melt 110 is injected into a prepared mold frame 400. In exemplary embodiments the amount of the inoculant input during the injection into the mold is limited to 0.3±0.05% by weight (%). Through the process, the manufacture of the high-strength flake graphite cast iron for an engine cylinder block and engine cylinder head is completed.

The high-strength flake graphite cast iron of the present disclosure manufactured as described above has strength higher than the flake graphite cast iron having a tensile strength in a range of 250 to 350 MPa, which is currently used in an engine cylinder block and head, and exhibits workability and fluidity, which are equivalent thereto. In addition, a chilling tendency is significantly low even though manganese (Mn) is added in a large amount. Furthermore, even though the flake graphite cast iron of the present disclosure is applied to an engine cylinder block and head having a complicated shape, in which a thick walled part having a cross-sectional thickness of 30 mm or more and a thin walled part having a cross-sectional thickness of approximately 5 to 10 mm are simultaneously present, it is possible to obtain a flake graphite cast iron in which the difference in the ratio of containing an A+D type graphite constituting the thick walled part and the thin walled part is less than 10% by a cross-sectional area.

<Engine Body for Internal Combustion Engine>

Furthermore, the flake graphite cast iron of the present disclosure is a high-strength material having a tensile strength of 350 MPa or more, and thus, may be applied to an engine body for an internal combustion engine, particularly, an engine cylinder block, an engine cylinder head, which have a complicated shape so that the thick walled part and the thin walled part are simultaneously present, or both. Such an engine body may satisfy the recent exhaust gas environmental regulations because the explosion pressure may exceed 220 bar.

For reference, since the terms to be described below are those set in consideration of the function in the present disclosure, and may vary depending on the intention of the producer or the customs, the definition thereof needs to be given based on the contents described in the present specification. For example, the engine body in the present disclosure means the configuration of an engine including an engine cylinder block, an engine cylinder head, and a head cover.

An engine cylinder block and/or an engine cylinder head, to which the flake graphite cast iron according to the present disclosure is applied as a material, include or includes a thin walled part having a cross-sectional thickness of approximately 5 to 10 mm and a thick walled part having a cross-sectional thickness of 30 mm or more, and the graphite shape constituting the thin walled part is in exemplary embodiments an A+D type. Actually, it can be confirmed that thin walled parts in which the flake graphite cast iron of the present disclosure is applied to a cylinder block are all A+D type graphite shapes (see FIGS. 5 to 11).

Hereinafter, Examples of the present disclosure will be described in more detail. However, the following Examples are exemplified for better understanding of the present disclosure, and the scope of the present disclosure should not be construed to be limited thereto, and various modifications and changes can be made from the following Examples without departing from the spirit of the present disclosure.

Examples 1 to 7 and Comparative Examples 1 to 7

Flake graphite cast iron according to Examples 1 to 7 and Comparative Examples 1 to 7 was manufactured according to the compositions of the following Table 1.

TABLE 1

| Classification | C | Si | Mn | S | P | Cu | Mo | Sr | Mn/Sr | Other components | Fe |
|---|---|---|---|---|---|---|---|---|---|---|---|
| Example 1 | 3.09 | 2.29 | 1.479 | 0.128 | 0.033 | 0.738 | 0.298 | 0.0047 | 314 | | Balance |
| Example 2 | 3.08 | 2.27 | 1.469 | 0.125 | 0.034 | 0.737 | 0.304 | 0.0059 | 249 | | Balance |
| Example 3 | 3.19 | 2.18 | 1.598 | 0.108 | 0.037 | 0.768 | 0.341 | 0.0031 | 515 | | Balance |
| Example 4 | 3.18 | 2.18 | 1.301 | 0.111 | 0.037 | 0.694 | 0.327 | 0.0060 | 216 | | Balance |
| Example 5 | 3.05 | 2.07 | 1.523 | 0.130 | 0.037 | 0.742 | 0.258 | 0.0051 | 299 | | Balance |
| Example 6 | 3.08 | 2.23 | 1.366 | 0.103 | 0.029 | 0.708 | 0.339 | 0.0041 | 333 | | Balance |
| Example 7 | 3.12 | 2.11 | 1.578 | 0.120 | 0.035 | 0.771 | 0.311 | 0.0035 | 451 | | Balance |
| Comparative Example 1 | 3.20 | 2.19 | 1.01 | 0.129 | 0.040 | 0.706 | 0.254 | 0.0054 | 187 | | Balance |
| Comparative Example 2 | 3.15 | 2.22 | 1.577 | 0.119 | 0.027 | 0.711 | 0.301 | 0.0025 | 631 | | Balance |
| Comparative Example 3 | 3.17 | 2.10 | 2.37 | 0.127 | 0.030 | 0.689 | 0.266 | 0.0041 | 578 | | Balance |
| Comparative Example 4 | 3.21 | 2.09 | 0.72 | 0.110 | 0.028 | 0.701 | 0.291 | 0.0052 | 138 | | Balance |
| Comparative Example 5 | 3.23 | 2.25 | 1.527 | 0.124 | 0.030 | — | — | — | — | — | Balance |
| Comparative Example 6 | 3.18 | 2.12 | 1.301 | 0.129 | 0.028 | 0.706 | 0.251 | — | — | 0.03% Sb | Balance |
| Comparative Example 7 | 3.24 | 2.17 | 0.62 | 0.085 | 0.030 | 0.68 | 0.193 | 0.0175 | 35 | | Balance |

First, an initial melt containing carbon (C), silicon (Si), manganese (Mn), sulfur (S) and phosphorus (P) was prepared according to the composition of Table 1. Without being separately added, phosphorus (P) was used as an impurity included in a raw material for casting, but was adjusted such that the content thereof was 0.06% or less.

Before tapping, the carbon equivalent (CE) was measured by using a carbon equivalent measuring device and the content of carbon (C) was adjusted to 3.0 to 3.2%, and alloy iron such as copper (Cu), molybdenum (Mo) and manganese (Mn) was adjusted to the composition as described in Table 1. The melting was completed by adding strontium (Sr) thereto, and then tapping was performed. In this case, a primary inoculation was performed by inputting an Fe—Si-based inoculant simultaneously with the tapping. After the tapping into the ladle was completed, the temperature of the melt was measured and the melt was injected into a prepared mold. In this case, a flake graphite cast iron product for an engine cylinder block and head was manufactured by inputting the Fe—Si-based inoculant simultaneously with the injection to perform a secondary inoculation.

The carbon equivalents, tensile strengths, Brinell hardnesses and chill depths of the cast iron in Examples 1 to 7 and Comparative Examples 1 to 7 manufactured according to the composition in Table 1 were respectively measured and are shown in the following Table 2.

TABLE 2

| Classification | Carbon equivalent (C.E.) | Tensile strength ($N/mm^2$) | Hardness (HBW) | Chill depth (mm) | Fluidity (mm) | Thin walled graphite shape |
|---|---|---|---|---|---|---|
| Example 1 | 3.85 | 360 | 263 | 1 | 743 | A + D |
| Example 2 | 3.84 | 355 | 245 | 1 | 752 | |

TABLE 2-continued

| Classification | Carbon equivalent (C.E.) | Tensile strength ($N/mm^2$) | Hardness (HBW) | Chill depth (mm) | Fluidity (mm) | Thin walled graphite shape |
|---|---|---|---|---|---|---|
| Example 3 | 3.92 | 375 | 279 | 2 | 738 | |
| Example 4 | 3.91 | 358 | 258 | 1 | 760 | |
| Example 5 | 3.74 | 362 | 266 | 1 | 746 | |
| Example 6 | 3.82 | 359 | 256 | 1 | 765 | |
| Example 7 | 3.82 | 362 | 258 | 2 | 759 | |
| Comparative Example 1 | 3.93 | 341 | 239 | 1 | 771 | A + D + E |
| Comparative Example 2 | 3.89 | 372 | 299 | 6 | 703 | D + E |
| Comparative Example 3 | 3.87 | 385 | 310 | 8 | 643 | D + E |
| Comparative Example 4 | 3.91 | 322 | 231 | 4 | 775 | A + D |
| Comparative Example 5 | 3.98 | 298 | 217 | 1 | 673 | A |
| Comparative Example 6 | 3.87 | 352 | 277 | 4 | 732 | A + D + E |
| Comparative Example 7 | 3.96 | 331 | 224 | 0 | 788 | A + B |

As seen from Table 2 above, it could be seen that the cast iron according to Examples 1 to 7 in which the ratio of Mn/Sr is adjusted to a range of 216 to 515 had a tensile strength in a range of 355 to 375 and a Brinell hardness (HBW) in a range of 245 to 279. Further, it could be seen that the chill depth was 3 mm or less, and the fluidity test specimen had a spiral length of 730 mm or more.

In addition, it could be seen that while Comparative Examples 2, 3, and 6 all had a D+E type graphite shape, except for Comparative Examples 7 1, and 5, which are a material having a 300 MPa-level tensile strength, the thin walled parts, in which the flake graphite cast iron of Examples 1 to 7 of the present application was applied to a cylinder block, all had an A+D type graphite shape (see Table 2 and FIGS. 5 to 18).

For reference, Comparative Examples 1, 3, and 4 are the same as Examples 1 to 7 in terms of the content of the composition and the manufacturing process of cast iron, but are examples in which both the content of manganese (Mn) and the ratio of Mn/Sr depart from the composition ranges of the present disclosure.

Comparative Example 2 is the same as Examples 1 to 7 in terms of the content of the composition and the manufacturing process, but are examples in which both the content of strontium (Sr) and the ratio of Mn/Sr depart from the composition ranges of the present disclosure.

Comparative Example 5 is a material to which manganese (Mn) and sulfur (S) are simply further added without adding alloy iron such as copper (Cu) and molybdenum (Mo).

Comparative Example 6 is the same as Examples 1 to 7 in terms of the content of the composition and the manufacturing process, but is a material to which antimony (Sb) is further added without adding strontium (Sr).

Comparative Example 7 is a material having a 300 MPa-level tensile strength developed in the related art in order to manufacture high-strength graphite cast iron for an engine cylinder block and head.

As a result, it can be seen that the high-strength flake graphite cast iron according to the present disclosure has both stable tensile strength and hardness, and chill depth and fluidity, and thus may be usefully applied to an engine cylinder block and engine cylinder head which requires high strength such as a tensile strength of 350 MPa or more.

Although the present disclosure has been described with reference to exemplary embodiments, workers skilled in the art will recognize that changes may be made in form and detail without departing from the spirit and scope of the disclosure.

The invention claimed is:

1. A flake graphite cast iron comprising 3.0 to 3.2% of carbon (C), 2.0 to 2.3% of silicon (Si), 1.3 to 1.6% of manganese (Mn), 0.1 to 0.13% of sulfur (S), 0.06% or less of phosphorus (P), 0.6 to 0.8% of copper (Cu), 0.25 to 0.35% of molybdenum (Mo), 0.003 to 0.006% of strontium (Sr), and the balance iron (Fe) satisfying 100% as a total weight %, and having a chemical composition, in which a ratio (Mn/Sr) of the content of manganese (Mn) to the content of strontium (Sr) is in a range of 216 to 515.

2. The flake graphite cast iron of claim 1, wherein the flake graphite cast iron has a chemical composition, in which the ratio (Mn/Sr) of the content of manganese (Mn) to the content of strontium (Sr) is in a range of 299 to 451.

3. The flake graphite cast iron of claim 1, wherein the flake graphite cast iron has a tensile strength of 355 to 375 MPa.

4. The flake graphite cast iron of claim 1, wherein the flake graphite cast iron has a Brinell hardness (BHW) of 245 to 279.

5. The flake graphite cast iron of claim 1, wherein a wedge test specimen has a chill depth of 3 mm or less.

6. The flake graphite cast iron of claim 1, wherein a fluidity test specimen has a spiral length of 730 mm or more.

7. The flake graphite cast iron of claim 1, wherein the flake graphite cast iron has a carbon equivalent (CE) in a range of 3.70 to 4.0.

8. An engine body for an internal combustion engine, comprising an engine cylinder block, an engine cylinder head, or both, which are made of the flake graphite cast iron of claim 1.

9. The engine body of claim 8, wherein the engine cylinder block or the engine cylinder head comprises a thin walled part having a cross-sectional thickness in a range of 5 to 10 mm and a thick walled part having a cross-sectional thickness of more than 30 mm, and a graphite shape constituting the thin walled part is an A+D type.

10. The engine body of claim 8, wherein the engine body has an explosion pressure of more than 220 bar.

11. A method for manufacturing high-strength flake graphite cast iron of claim 1, the method comprising:

(i) manufacturing a cast iron melt including 3.0 to 3.2% of carbon (C), 2.1 to 2.3% of silicon (Si), 1.3 to 1.6% of manganese (Mn), 0.10 to 0.13% of sulfur (S), 0.06% or less of phosphorus (P), 0.6 to 0.8% of copper (Cu), 0.25 to 0.35% of molybdenum (Mo), and the balance iron (Fe) based on a total weight %;

(ii) adding strontium (Sr) to the melted cast iron melt, in which a ratio (Mn/Sr) of the content of manganese (Mn) to the content of strontium (Sr) is adjusted to be in a range of 216 to 515; and (iii) tapping the cast iron melt into a ladle and injecting the cast iron melt into a prepared mold.

12. The method of claim 11, wherein an amount of strontium added is in a range of 0.003 to 0.006% based on the total weight % of the cast iron melt.

13. The method of claim 11, wherein the cast iron melt in step (i) is manufactured by adding 0.6 to 0.8% of copper (Cu) and 0.25 to 0.35% of molybdenum (Mo) to a cast iron melt manufactured by melting a cast iron material including 3.0 to 3.2% of carbon (C), 2.0 to 2.3% of silicon (Si), 1.3 to 1.6% of manganese (Mn), 0.10 to 0.13% of sulfur (S), 0.06% or less of phosphorus (P), and the balance iron (Fe) based on the total weight % in a furnace.

14. The method of claim 11, wherein an Fe—Si-based inoculant is added one or more times in step (iii).

15. The method of claim 14, wherein the Fe—Si-based inoculant is added when the cast iron melt is tapped into the ladle, when the cast iron melt is injected into the mold, or in both of the steps.

* * * * *